US009587815B2

(12) United States Patent
Gielen et al.

(10) Patent No.: US 9,587,815 B2
(45) Date of Patent: Mar. 7, 2017

(54) END CAP FOR A TUBULAR LIGHT SOURCE

(75) Inventors: Vincent Stefan David Gielen, Eindhoven (NL); Peter Johannes Martinus Bukkems, Deurne (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 158 days.

(21) Appl. No.: 14/007,402

(22) PCT Filed: Mar. 22, 2012

(86) PCT No.: PCT/IB2012/051367

§ 371 (c)(1),
(2), (4) Date: Oct. 10, 2013

(87) PCT Pub. No.: WO2012/131547

PCT Pub. Date: Oct. 4, 2012

(65) Prior Publication Data

US 2014/0029247 A1 Jan. 30, 2014

(30) Foreign Application Priority Data

Mar. 30, 2011 (EP) ..... 11160377

(51) Int. Cl.
*F21V 23/04* (2006.01)
*F21V 19/00* (2006.01)
(Continued)

(52) U.S. Cl.
CPC ..... *F21V 23/04* (2013.01); *F21K 9/27* (2016.08); *F21V 19/008* (2013.01); *F21V 23/06* (2013.01);
(Continued)

(58) Field of Classification Search
USPC .... 362/217.01, 217.02, 217.13, 217.17, 225; 200/61.39, 329, 334, 336, 341
See application file for complete search history.

(56) References Cited

U.S. PATENT DOCUMENTS 4,211,958 A 7/1980 Bickford et al.
8,459,831 B2 † 6/2013 Hsia
(Continued)

FOREIGN PATENT DOCUMENTS

CN 101737664 A 6/2010
CN 201535456 U 7/2010
(Continued)

*Primary Examiner* — Andrew Coughlin
*Assistant Examiner* — Meghan Ulanday

(57) ABSTRACT

An end cap (104) for a tubular light source (102), the tubular light source (102) being configured to be arranged in a lighting fixture (106) comprising at least one socket (108), wherein the end cap (104) comprises a housing (202), two connector pins (112) at least partly arranged on an outside of the housing (202) and adapted to fit in the socket, and a switch assembly comprising a switch element (110) arranged in between the two connector pins (112) and at least partly protruding from an opening in the housing (202), wherein a first side of the switch element (110) is adapted to fit into a slot in a socket (108) and wherein the switch assembly is configured to form a conductive path between the socket (108) and the tubular light source (102) through an axial rotation of the switch element (110) in relation to the housing (202) as the tubular light source (102) is rotatably mounted in the fixture (106).

17 Claims, 3 Drawing Sheets

(51) Int. Cl.

| | |
|---|---|
| ***F21V 23/06*** | (2006.01) |
| ***F21V 25/04*** | (2006.01) |
| ***H01R 33/94*** | (2006.01) |
| ***H01R 33/96*** | (2006.01) |
| *F21S 8/00* | (2006.01) |
| *F21Y 101/00* | (2016.01) |

(52) U.S. Cl.
CPC ..... *F21V 25/04* (2013.01); *H01R 33/942* (2013.01); *H01R 33/96* (2013.01); *F21S 8/031* (2013.01); *F21Y 2101/00* (2013.01)

(56) References Cited

U.S. PATENT DOCUMENTS

| | | | | |
|---|---|---|---|---|
| 2010/0181178 | A1 | 7/2010 | Chang et al. | |
| 2012/0106157 | A1* | 5/2012 | Simon ..... | F21V 25/04<br>362/249.05 |

FOREIGN PATENT DOCUMENTS

| | | | |
|---|---|---|---|
| CN | 301471065 | S | 2/2011 |
| CN | 202048395 | U | 11/2011 |
| JP | 2010192229 | A | 9/2010 |
| JP | 2010192242 | A | 9/2010 |
| WO | 2009067074 | A1 | 5/2009 |
| WO | 2009143047 | A2 | 11/2009 |
| WO | 2010069983 | A1 | 6/2010 |

* cited by examiner
† cited by third party

END CAP FOR A TUBULAR LIGHT SOURCE

FIELD OF THE INVENTION

The present invention relates to an end cap for a tubular light source, and in particular to an end cap enabling safe installation of such a tubular light source.

BACKGROUND OF THE INVENTION

Fluorescent lighting tubes are commonly used in a large range of lighting systems as a result of advantages such as longer life time and better luminous efficiency compared to incandescent lamps. However, in the continuous effort to reduce power consumption, it is desirable to replace conventional light tubes with still more energy efficient and environmental friendly alternatives. One such alternative is to use LED tubular light sources having a plurality of LED's arranged in a tube similar to the fluorescent tube. In order to facilitate a transition from fluorescent tube lights to LED tubular light sources, the LED tubular light sources should be configured to be mounted in already existing fixtures for fluorescent light tubes. However, the electrical circuitry is different in an LED tubular light source compared to in a fluorescent light tube in that the LED tube may provide a current path between the two end caps. As a result, installation of retrofitted LED tubular light sources may be a safety hazard as it is possible to first install one end cap in the mains connected fixture while having the other end cap still exposed and carrying a live potential on the connection pins of the exposed cap. Thus, the installer may touch the exposed end cap and get an electrical shock.

US2010/018178 discloses a suggestion on how the aforementioned safety issue may be alleviated by introducing a safety switch in the end cap of the LED tubular light source. However, a push-in safety switch according to US2010/018178 may in some cases be unintentionally engaged when the installer is pushing a first end of the tubular light source as a second end is inserted into the fixture, thereby exposing the installer to potential hazard as the unconnected end cap may then have a live potential. Furthermore, the installer may gain a false sense of security as the presence of a safety switch may make the installer believe that installation is safe in all circumstances.

Therefore, there is a need for an improved safety mechanism to improve the safety for the installer when installing retrofitted LED tubular light sources.

SUMMARY OF THE INVENTION

In view of the aforementioned and other drawbacks of prior art, it is an object of the present invention to improve the safety when installing a tubular light source, in particular it is an object to provide an end cap for a tubular light source comprising LEDs, the end cap further comprising a safety switch to facilitate safe installation of the tubular light source in a fixture.

According to an aspect of the present invention, it is therefore provided an end cap for tubular light source, the tubular light source being configured to be arranged in a lighting fixture comprising at least one socket, wherein the end cap comprises a housing, two connector pins at least partly arranged on an outside of the housing and adapted to fit in the socket, and a switch assembly comprising a switch element arranged in between the two connector pins and at least partly protruding from an opening in the housing, wherein a first side of the switch element is adapted to fit into a slot in a socket and wherein the switch assembly is configured to form a conductive path between the socket and the tubular light source through an axial rotation of the switch element in relation to the housing as the tubular light source is rotatably mounted in the fixture.

The present invention is based on the realization that a safety switch for a tubular light source may advantageously be integrated into the end cap of the tube and that the safety switch preferably is automatically closing an electrical circuit by forming a conductive path between the socket and the tubular light source during installation of such a light source. In particular, in some tubular light sources, the internal circuitry is arranged so that the light source may provide a conductive path from the connector pins in one end portion of an elongate tube to connector pins in the opposite end portion even if the light source is not active contrary to what was possible in conventional fluorescent light tubes. In other words, it is possible that mounting one end portion of the tubular light source in the socket of the lighting fixture leads to the connector pins in the opposite end portion carrying a live voltage. In particular, having a push-in mechanism arranged on the end cap may cause the installer to unintentionally push the safety mechanism during installation of the tubular light source, thereby engaging the electrical circuit. By having a switch which automatically closes an electrical circuit only when the connector pins are out of reach for the installer, the risk for the installer of receiving an electrical shock when installing a tubular light source is significantly reduced.

In one embodiment, the conductive path may advantageously be formed at a second side of the switch element, wherein the second side is arranged inside of the housing. Arranging the switch mechanism inside of the housing provides additional safety as any conductive part is out of reach. The conductive path may for example be formed by aligning a conductive element with the two connector pins, wherein the conductive element is electrically connected to the tubular light source. Such a switch arrangement ensures that the connector pins are only electrically connected after the tubular light source has been installed in the fixture.

According to one embodiment the switch element may be equipped with screw threads enabling axial movement of the switch element through a rotation of the switch element in relation to the housing. Furthermore, by using an axially movable switch element having screw threads, the conductive path may advantageously be formed through an axial movement of the switch element. More particularly, the switch element is preferably arranged in the housing so that the rotation coincides with the rotational mounting of the tubular light source in a way that no extra steps are required to be performed by the person installing the light source. However, the configuration of the switch element is not limited to the aforementioned switch elements, the switch element may equally well be any rotary switch element known to the person skilled in the art performing the above described function.

In one embodiment, the tubular light source may advantageously comprise a plurality of LEDs. LEDs are advantageously used as a replacement for fluorescent light sources as LED are more power efficient, smaller in size and have a longer life-length as well as being more environmental friendly. Thereby, using LEDs may improve a tubular light source both with regard to environmental aspects and to the overall economy of the light source as power consumption is reduced and as fewer replacements are needed.

According to one embodiment, at least one end cap as discussed above may advantageously be arranged on at least one end of a tubular illuminator part comprising a plurality of light emitting elements in order to form a tubular light source. Furthermore, such a tubular light source may advantageously be provided with an appropriate fixture comprising at least one socket for receiving the at least one end cap and for connecting the tubular light source to an electrical power supply, thereby forming a luminaire. Additionally, the tubular light source may advantageously comprise optics configured to mix light. Such optics may be any mixing and/or collimating means. Light mixing optics may advantageously be used if the light emitting elements comprise LEDs. However, the light emitting elements may be any light source such as a fluorescent or incandescent light source.

BRIEF DESCRIPTION OF THE DRAWINGS

These and other aspects of the present invention will now be described in more detail with reference to the appended drawings showing currently preferred embodiments of the invention, wherein.

DETAILED DESCRIPTION

Figure 1A:
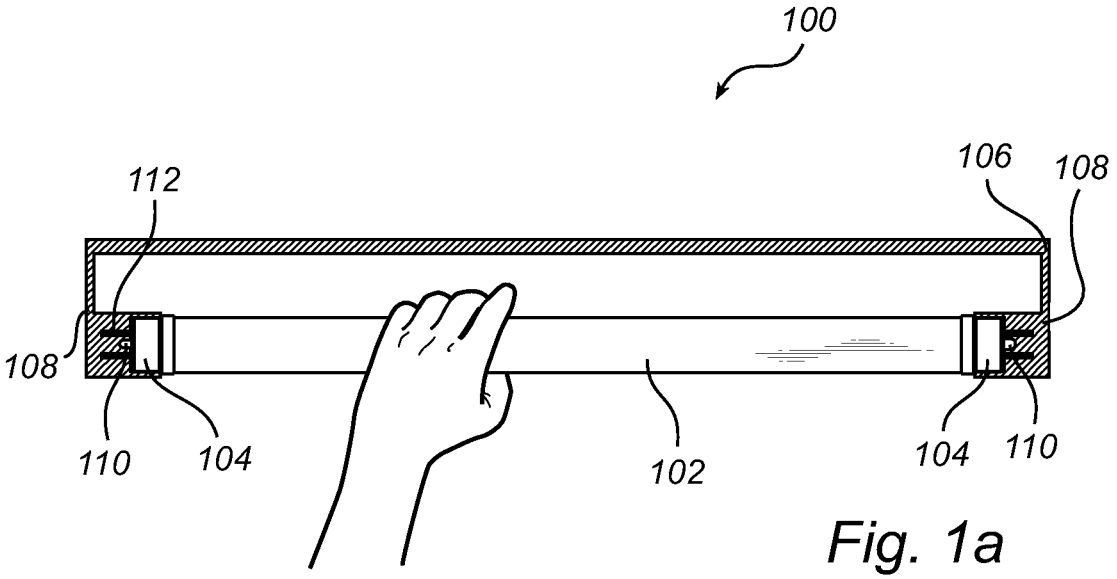
FIG. 1 illustrates a circuit arrangement.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

In order for an electrically powered device to be powered a closed circuit through which electrical current can flow needs to be established. Typical examples of electrically powered devices include, but are not limited to, light sources, luminaires, LED retrofits of linear TL tubes, and the like. Electrically powered devices are provided with electrical connecting means by which the electrically powered devices can be electrically connected to an interface (such as a device socket or a device holder) of a fixture which in turn is connected to an electrical power supply. Hence, when properly connected to the interface an electrical current may be provided to the electrically powered device. Commonly, the electrically powered device has two electrical connecting means (electrical contacts, such as pins) for connecting the electrically powered device to the electrical power supply via the interface to result in a closed circuit. Some electrically powered devices have more than two electrical connecting means which enable multiple current paths.

Furthermore, for most common electrical connecting means where all pins of the electrical connecting means are at the same end, such as the normal mains plug of an electrically powered device, it is due to the length of the pins and the size of the socket not possible to connect only one pin whilst leaving the other pin exposed so that it may be accidently touched. However, there are also some types of housings which have all electrical connecting means at one end. In some cases the mechanical design (geometry, shape, etc.) of the housing and/or interface, possibly together with the placing of the electrical connecting means on the housing, may prevent the electrical connecting means from being connected to the interface means in a wrong way, and thereby prevent unsecure installation. But in other cases this does not prevent the electrical connecting means from being connected to the interface means in an unsecure way.

The potential hazard described above may relate to retrofit LED tubular light sources as the power converter/ballast provides a current path through the tube. In contrast to this, a gas filled tube may not conduct any current unless ignited by the ignition voltage which commonly requires a connection at both ends of the tubular light source. Hence, due to the nature of the different types of electrically powered devices the installer might not be aware of the potential hazard originating from the uninstalled pins.

In the following, various embodiments of an end cap according to the present invention are mainly discussed with reference to an end cap for a tubular light source providing safety through a rotational motion.

Figure 1B:
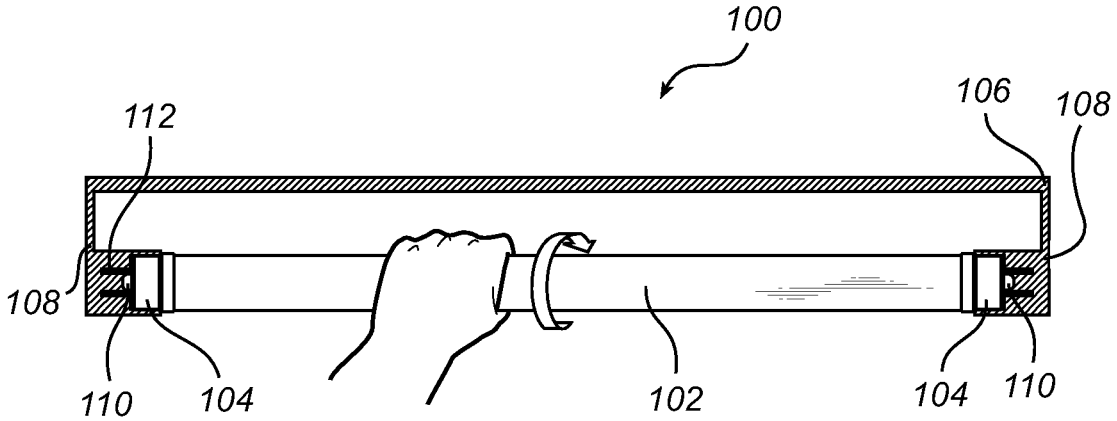

FIGS. 1*a* and 1*b* schematically illustrates a luminaire 100 wherein a tubular light source 102 comprising an end cap 104 according to the present invention is being mounted into a fixture 106. The fixture 106 is in turn connected to the power mains or any other power supply. The end cap 104 is adapted to be inserted into a socket 108 having a slot for receiving the connector pins 112 of the end cap 104. The end cap 104 is further equipped with a switch element 110 which closes the electrical circuit of the luminaire 100 upon rotation of the end cap 104 in relation to the socket when the end cap is mounted in the socket. The connector pins 112 and the switch element 110 of the end cap 104 are further configured to be inserted into a receiving slot in the socket 108 simultaneously. As illustrated in a first step FIG. 1*a*, the end caps 104 are inserted into the corresponding sockets 108 in the fixture 106 by sliding the connector pins 112 and the switch element 110 into the receiving slot in the socket 108. After that, the mounting is completed by rotating the tubular light source 102 as illustrated in FIG. 1*b*. As the tubular light source 102 is mechanically connected to the end cap, and the switch element 110 is rotationally connected to the end cap, the switch element 110 is simultaneously rotated in relation to the end cap 104. The rotation of the switch element 110 in relation to the end cap 104 forms a conductive path between the connector pins 112 and the tubular light source 102, thereby closing the electrical circuit of the luminaire 100.

Figure 2A:
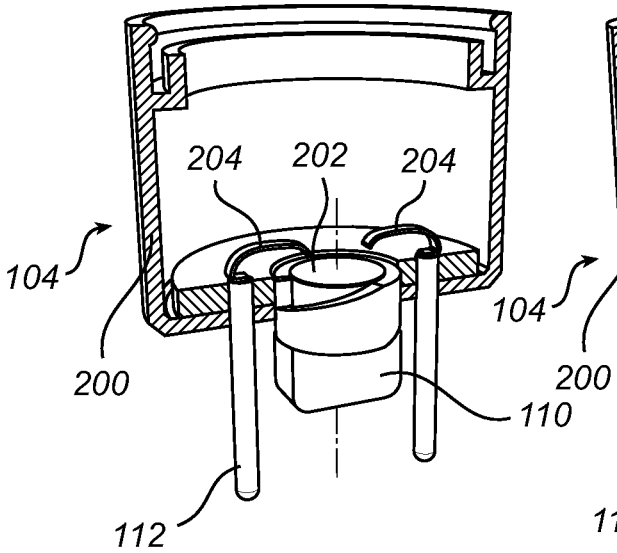
FIG. 2 is schematically illustrating an end cap according to an exemplary embodiment of the present invention.
Figure 2B:
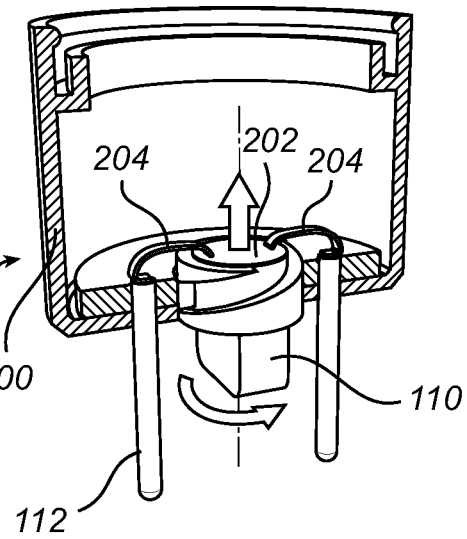

FIGS. 2 to 4 schematically illustrate various preferred embodiments of an end cap according to the present invention. A currently preferred embodiment will now be described with reference to FIG. 2 showing a sectional view of an end cap 104. The end cap comprises a housing 202 and a switch element 110 which is axially rotatable in relation to the housing 202. When the end cap 104 is mounted in a socket 108, both the connector pins 112 and the elongate protruding portion of the switch element 110 are inserted into a receiving slot in the socket 108. The switch element 110 in FIG. 2 is threaded and arranged with corresponding threads in the housing 202 so that when the switch element 110 is rotated through a rotation of the end cap 104 in the socket 108, the switch element 110 moves in an axial direction. The side of the switch element 110 facing the inside of the housing has a conductive surface 202 so that when the switch element 110 is moved in an axial direction, the conductive surface 202 makes contact with connecting means 204 attached to the connector pins 112 as illustrated in FIG. 2*b*. The conductive surface 202 of the switch element 110 is further connected to the tubular light source 102 so as to form a conductive path between the connector pins 112 and the tubular light source 102, thereby closing the electrical circuit of the luminaire 100, when the switch element 110 is rotated. The conductive portion 202 of the switch element 110 may also be connected to any intermediate control circuitry arranged between the end cap 104 and the tubular light source 102 required to operate the tubular light source 102.

Figure 3A:
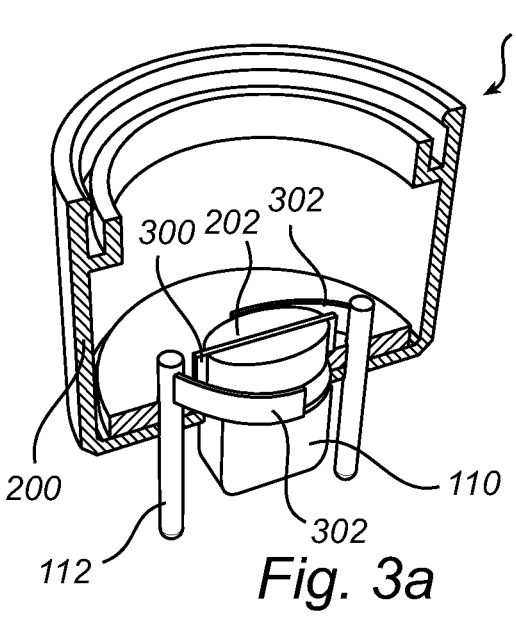
FIG. 3 is schematically illustrating an end cap according to another embodiment of the present invention.
Figure 3B:
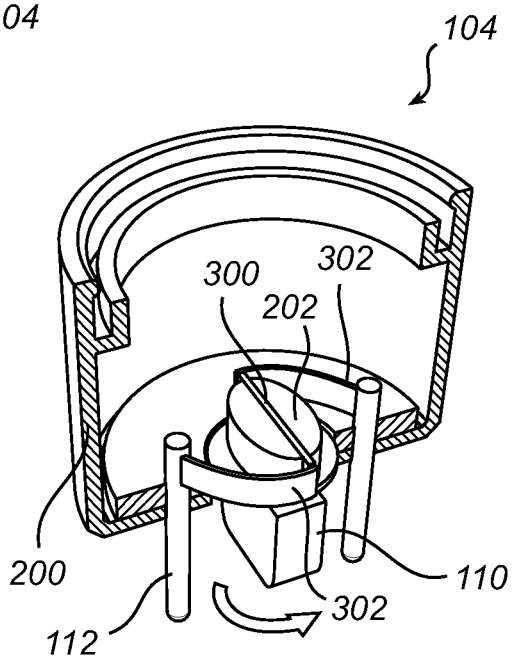

FIGS. 3*a* and 3*b* schematically illustrates an alternative embodiment of the end cap 104 wherein the switch element 110 is equipped with an embedded conductive element 300 traversing the switch element 110 thereby contacting the connecting means 302 upon rotation of the switch element 110 and forming a conductive path between the connector pins 112 and the tubular light source 102 analogously to previously described embodiments.

Figure 4A:
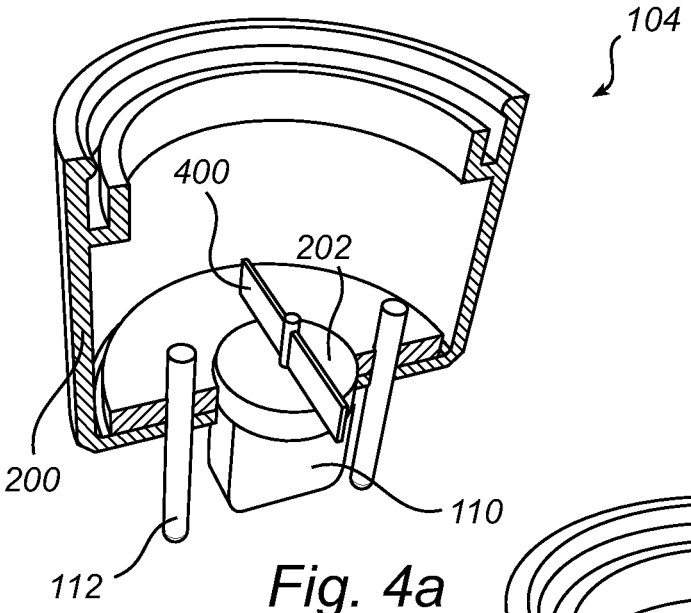
FIG. 4 is schematically illustrating an end cap according to another embodiment of the present invention.
Figure 4B:
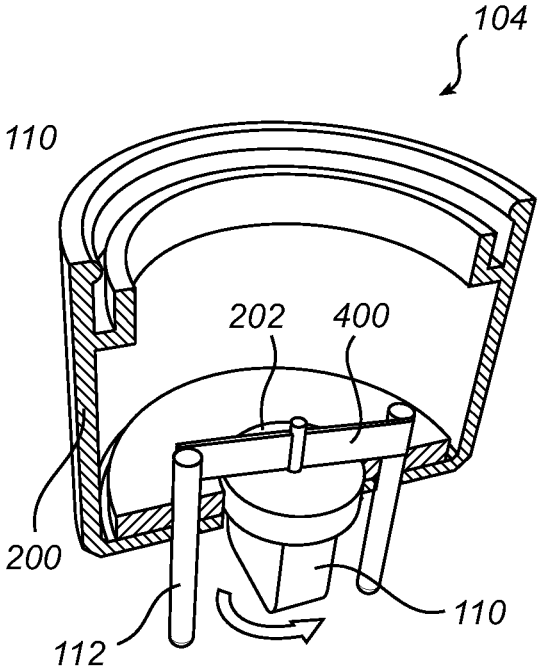

FIGS. 4*a* and 4*b* schematically illustrates another alternative embodiment of the end cap 104 where the switch element 110 is equipped with a conductive element 400 traversing the switch element 110 thereby contacting the connector pins 112 upon rotation of the switch element 110 and forming a conductive path analogously to previously described embodiments.

The disclosed end cap will work with any electrical circuitry inside the housing or the tubular light source and with any wiring and ballasting of the luminaire comprising the sockets 108 such as, but not limited to magnetic ballast, glow starter, electronic starter, series connection of lamps, HF cold start, HF warm start, shorted pins per end and the like.

Even though the invention has been described with reference to specific exemplifying embodiments thereof, many different alterations, modifications and the like will become apparent for those skilled in the art. For example, the switch element may be any rotary switch element known to the person skilled in the art. Also, it should be noted that parts of the disclosed end cap may be omitted, interchanged or arranged in various ways, the end cap yet being able to perform the functionality of the present invention.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An end cap for a tubular light source, the tubular light source being configured to be arranged in a lighting fixture comprising at least one socket defining a slot therein, the end cap comprising:

a housing defining an opening;

two connector pins at least partly arranged on an outside of the housing and adapted to fit in the slot in the socket; and a switch assembly comprising a switch element arranged in between the two connector pins and at least partly protruding from the opening, wherein a first side of the switch element is adapted to fit into the slot in the socket and wherein the switch assembly is configured to form a conductive path between the socket and the tubular light source through an axial rotation of the switch element in relation to the housing as the tubular light source is rotatably mounted in the fixture.

2. The end cap according to claim 1, wherein the conductive path is formed at a second side of the switch element, wherein the second side is arranged in an inside of the housing.

3. The end cap according to claim 1, wherein the switch element is equipped with screw threads enabling axial movement through a rotation of the switch element.

4. The end cap according to claim 1, wherein the conductive path is formed through an axial movement of the switch element.

5. The end cap according to claim 1, wherein the tubular light source comprises a plurality of light emitting elements.

6. A tubular light source configured to be arranged in a lighting fixture comprising at least one socket defining a slot therein, the tubular light source comprising:

an illuminator part comprising a plurality of light emitting elements; and at least one end cap part arranged on at least one end of the illuminator part, the end cap comprising:

a housing defining an opening;

two connector pins at least partly arranged on an outside of the housing and adapted to fit in the slot in the socket; and a switch assembly comprising a switch element arranged in between the two connector pins and at least partly protruding from the opening, wherein a first side of the switch element is adapted to fit into the slot in the socket and wherein the switch assembly is configured to form a conductive path between the socket and the tubular light source through an axial rotation of the switch element in relation to the housing as the tubular light source is rotatably mounted in the fixture.

7. The tubular light source according to claim 6, further comprising optics configured to mix light emitted by the light emitting elements.

8. The tubular light source according to claim 6, wherein the conductive path is formed at a second side of the switch element, wherein the second side is arranged in an inside of the housing.

9. The tubular light source according to claim 6, wherein the switch element is equipped with screw threads enabling axial movement through a rotation of the switch element.

10. The tubular light source according to claim 6, wherein the conductive path is formed through an axial movement of the switch element.

11. The tubular light source according to claim 6, further comprising a plurality of light emitting elements.

12. A luminaire comprising:

a tubular light source comprising an illuminator part comprising a plurality of light emitting elements and at least one end cap part arranged on at least one end of the illuminator part; and a fixture comprising at least one socket for receiving the at least one end cap and for connecting the tubular light source to an electrical power supply, wherein the end cap of the tubular light source comprises:

a housing defining an opening;

two connector pins at least partly arranged on an outside of the housing and adapted to fit in the slot in the socket; and a switch assembly comprising a switch element arranged in between the two connector pins and at least partly protruding from the opening, wherein a first side of the switch element is adapted to fit into the slot in the socket and wherein the switch assembly is configured to form a conductive path between the socket and the tubular light source through an axial rotation of the switch element in relation to the housing as the tubular light source is rotatably mounted in the fixture.

13. The luminaire according to claim 12, wherein the tubular light source further comprises optics configured to mix light emitted by the light emitting elements.

14. The luminaire according to claim 12, wherein the conductive path is formed at a second side of the switch element, wherein the second side is arranged in an inside of the housing.

15. The luminaire according to claim 12, wherein the switch element is equipped with screw threads enabling axial movement through a rotation of the switch element.

16. The luminaire according to claim 12, wherein the conductive path is formed through an axial movement of the switch element.

17. The luminaire according to claim 12, further comprising a plurality of light emitting elements.

* * * * *